United States Patent [19]

Mattei et al.

[11] Patent Number: 4,597,246

[45] Date of Patent: Jul. 1, 1986

[54] MACHINE FOR WRAPPING AND GROUPING PRODUCTS

[75] Inventors: Riccardo Mattei; Antonio Gamberini, both of Bologna, Italy

[73] Assignee: G. D. Societa Per Azioni, Bologna, Italy

[21] Appl. No.: 675,965

[22] Filed: Nov. 28, 1984

[30] Foreign Application Priority Data

Dec. 7, 1983 [IT] Italy ..... 3648 A/83

[51] Int. Cl.[4] ..... B65B 35/30

[52] U.S. Cl. ..... 53/542; 53/201; 53/234

[58] Field of Search ..... 53/171, 176, 542, 234, 53/201; 198/404, 408

[56] References Cited

U.S. PATENT DOCUMENTS

| | | | |
|---|---|---|---|
| 3,151,728 | 10/1964 | Schmermund | 198/404 |
| 4,020,608 | 5/1977 | Seragnoli | 53/234 |
| 4,265,073 | 5/1981 | Seragnoli | 53/234 X |
| 4,352,264 | 10/1982 | Seragnoli | 53/171 X |
| 4,352,265 | 10/1982 | Hansel | 53/171 X |

FOREIGN PATENT DOCUMENTS

| | | | |
|---|---|---|---|
| 920146 | 3/1963 | United Kingdom | 53/234 |

*Primary Examiner*—John Sipos

*Attorney, Agent, or Firm*—Karl F. Ross; Herbert Dubno

[57] ABSTRACT

A machine for wrapping and grouping products of parallelepedic and/or flat shapes is described, in which the individual products are wrapped by a first wheel and conveyed to a second wheel designed to form, in an alternate manner, two types of groups, in the first of which the products are positioned together in a flat manner and in the second of which the products are positioned together in an arrangement which intersects a plane which is perpendicular to the longitudinal dimension of the products themselves. The products are conveyed from the wrapping wheel to the wheel for forming the groups by means of a conveyor head having sections, whose position may be varied in order to enable the removal of the products from different positions of the wrapping wheel and consequently to enable the production of groups of the first or the second type.

3 Claims, 4 Drawing Figures

MACHINE FOR WRAPPING AND GROUPING PRODUCTS

FIELD OF THE INVENTION

The present invention relates to a machine for wrapping and grouping products and in particular, to a machine designed to wrap individual products having a substantially parallelepipedic and/or flat shape (sweets, pastilles etc.), and then to combine these products into groups having a specific number of units and to undertake their external packaging.

BACKGROUND OF THE INVENTION

As is known, the groups formed by a machine of the abovementioned type are conventionally called "sticks".

In conventional packaging, the products forming the sticks are positioned together so that their larger faces are in contact, i.e. they are disposed with their flat sides together.

Sticks have recently been introduced into the market in which the products are positioned together in an arrangement which intersects a plane which is perpendicular to the longitudinal dimension of the groups.

Using the known techniques, the sticks of the first and the second types described above are often produced by different machines, which are expressly constructed to produce sticks of one or the other type.

As an alternative, and in accordance with the U.S. Pat. No. 4,265,073 of the applicants, for example, both types of sticks may be produced using the same machine.

In the case of this machine, the individual products are firstly wrapped while being conveyed by a rotary wrapping wheel and are than removed from the latter and inserted, one after the other, within the axial peripheral recesses of a conveyor wheel designed to contain, within each recess, a number of products which is equal to the number of products forming the stick. The product groups formed in this way are then removed from this conveyor wheel and introduced successively into the peripheral recesses of a wrapping wheel.

In the case of the machine in question, the conveyor and wrapping wheels are supported by a column resting on the base of the machine itself, whose position may be adjusted with respect to the wrapping wheel. Consequently, the conveyor wheel may be brought into two different zones, in order to obtain one or the other type of stick, of the wheel for wrapping the individual products, in which zones the products themselves may be removed from the wrapping wheel and introduced into the conveyor wheel in an arrangement which is either flat or which intersects a horizontal plane.

The machine described above, although operationally successful, is very complex and costly as a result of the use of the column moving freely on the base of the machine and which may be displaced with respect to the latter, the adjustment and guide means for the displacement of this column, and the inevitable complications linked to the motorization of wrapping and conveyor wheels whose mutual positions may be varied.

OBJECT OF THE INVENTION

The object of the present invention is to provide a machine for the wrapping and grouping of products which is able to combine the products at will in accordance with either of the arrangements described above, i.e. with the conventional flat arrangement, or in the arrangement which intersects a plane perpendicular to the longitudinal dimension of the groups, and in particular a machine which may be adapted, in accordance with requirements, to the production of groups of products of one or the other type in a simple and relatively inexpensive manner.

SUMMARY OF THE INVENTION

This object is achieved by the present invention in that it relates to a machine for the wrapping and grouping of products having a substantially parallelepipedic and flat shape in packages in which the products are grouped in a flat or in an intersecting manner, comprising two wheels provided with radial recesses for housing the products, one wheel being designed to convey the individual products and the other wheel being designed to form and convey the groups of individual products, wherein between the two wheels mentioned above, a conveyor head having recesses which may rotate about an axis which lies and may be angularly adjusted in a plane which is substantially parallel to the plane in which one of the two above wheels lies so as to be able to assume one of two end locking positions which form, between the third and first wheels, a first and a second product transfer position, in which positions the products are disposed in two respective arrangements which are rotated through one another by a different angle.

BRIEF DESCRIPTION OF THE INVENTION

The invention will now be described with reference to the accompanying drawing, which shows a preferred embodiment of the invention purely by way of non-limiting example, and in which.

SPECIFIC DESCRIPTION

Figure 1:
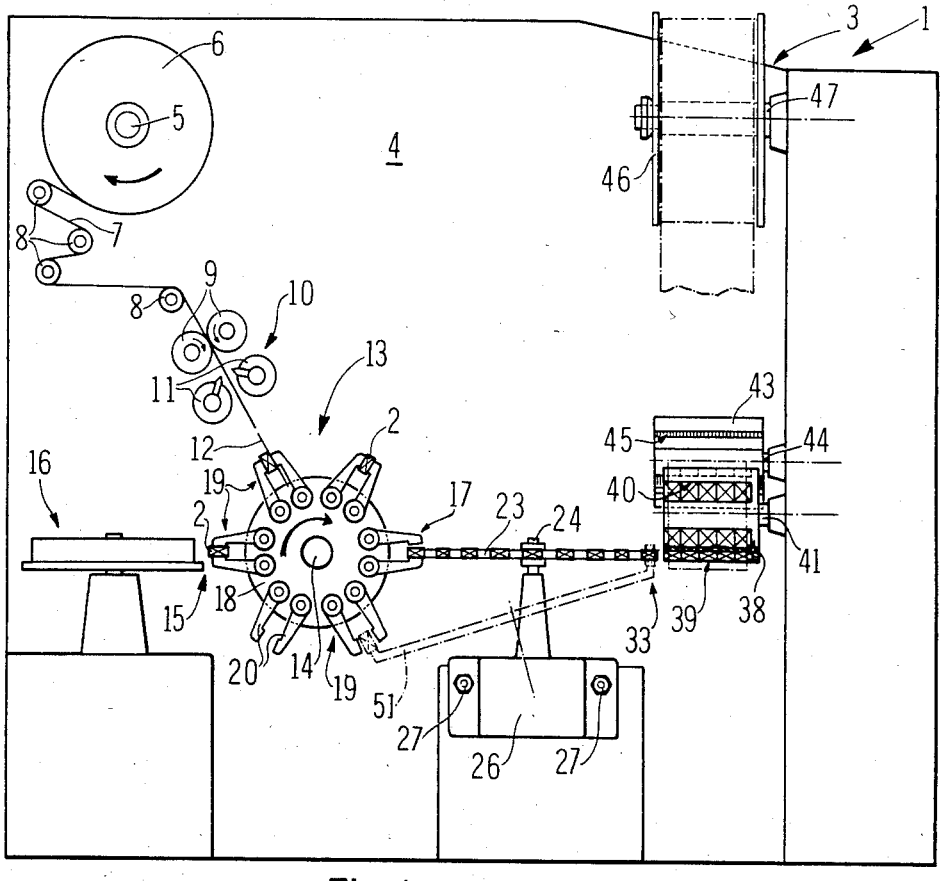
FIG. 1 is a diagrammatic front view of a wrapping machine constructed in accordance with the present invention.

With reference to FIG. 1, the wrapping machine is shown overall by 1 and is designed to wrap individual products 2 having a substantially parallelepipedic flat shape in succession and to group them, in order to enable a further exterior wrapping operation for the groups produced which are positioned together.

The machine 1 comprises a base 3, bounded at the rear by a vertical wall 4 supporting in a rotary manner, via a shaft 5, a spool 6 of wrapping material for individual products 2.

A strip of material 7 is unwound from the latter along a path defined by return rolls 8, via a pair of drive rolls 9 supported by the wall 4 and motorized in a manner which is not shown.

A cutting device 10 is disposed downstream of the rolls 9 and comprises two cutting rolls 11 rotating in opposite directions and designed to cut off successive pieces 12 from the strip 7 and to supply them to a wheel for conveying and wrapping the individual products 2 shown overall by 13.

The latter is supported by a shaft 14 perpendicular to the wall 4 and is provided with discontinuous rotary movement in a clockwise direction by motor means which are not shown. This wheel 13 is designed to receive the products 2 in succession, at the location of an intake position 15, from a supply device 16 and to wrap them and then to convey them to a transfer position 17 diametrically opposite to the position 15.

The wheel 13 comprises a disc 18 keyed on the shaft 14 and supporting six grippers 19 spaced at regular angular intervals. Each gripper 19 is composed of two arms 20 mounted at one end on pins 21 and provided at their other ends with take-up elements 22 for the products 2 made of resilient material. Actuator means of a known type (not shown) cause the opening and closing of each gripper 19 at specific positions and times and for specific periods of time.

During the rotation of the wheel 13 (see also FIG. 2), the path followed by the products 2 gripped between the gripper elements 22 intersects, at the transfer position 17, a peripheral portion of a wheel or head 23 having recesses and keyed on a shaft 24 supported vertically, via a tubular element 25, by a box-shaped body 26 fixed to the wall 4 by connection means or screws 27.

Motorization means (not shown), located within the box-shaped body 26 and connected to a power source (not shown) of the machine 1 provide this shaft 24 with a discontinuous rotary movement having a specific phase relationship with respect to the discontinuous rotation of the wheel 13.

On the peripheral edge of the head 23 there is provided a plurality of recesses 28 having a uniform angular spacing and each designed to receive a product 2 disposed horizontally and flat. The radially internal edge of each recess 28 has an indentation or slot 29 which is bounded in the radial direction of the shaft 24 by a face 30 in whose lower portion there is provided a chamfer 31.

A fixed fairing 32 having a peripheral flange 321 runs along the base and the sides of the head 23 periphery so as to keep the products 2 within the recesses 28 during the rotation of the head 23.

Removal means 34, comprising an articulated lever 35 having one end on a shaft 36 and supporting at its other end a bar 37 which is substantially perpendicular thereto and is provided at a discharge position 33 of the products 2 from the head 23, which position is diametrically opposite to the position 17.

The shaft 36 is provided with a rotary oscillating movement by motor means (not shown), and causes the bar, at each stop of the head 23, to travel, with a movement which is substantially radial with respect to the head 23, along the path defined by an chamfer 31 and an indentation 29 for the removal of the product 2 from the respective recess 28.

A wheel 38 for forming and conveying groups 39 of products 2, provided on its periphery with four axial recesses or compartments 40 which are angularly spaced in a uniform manner is keyed on a shaft 41 perpendicular to the shaft 14 and is supported in a rotary manner by the base 3, this wheel keeping one end of one fits recesses 40, during the removal of the products 2 from the recesses 28, at the discharge or transfer position 33 so as to receive the products 2 from the recesses 28 successively.

Motorization means (not shown) provide the shaft 41 with a discontinuous rotary movement having a specific phase relationship with respect to the rotation of the head 23 so as to stop the wheel 38, with a recess 40 stationary at the said transfer position 33, for the time required for the head 23 to carry out a number of rotations equal to the number of products 2 forming a stick. Consequently, during each stop period of the wheel 38, a group 39 formed by as many products 2 as required for a stick, is formed within a recess 40 of this wheel, these products being positioned together along one of their smaller faces.

The wheel 38 is partially surrounded by a fixed fairing 42 shown by a dot-dashed line, extending from the position 33 to a substantially tangential zone of the wheel 38 with a wheel 43 for wrapping the groups 39. The aim of this fairing 32 is to restrain the groups 39 within the recesses 40 during their formation and during their transfer by the wheel 38.

The wheel 43 is disposed parallel to the wheel 38, and is supported and provided with discontinuous rotary movement with a specific phase relationship with respect to the rotation of the wheel 38, by a shaft 44, supported in a rotary manner by the base 3 and connected to motorization means (not shown).

This wheel 43 is provided on its periphery with six radial recesses 45 having a uniform angular spacing and designed to receive the groups 39 coming from the wheel 38 as a result of the action of transfer means (not shown). In these recesses 45 the groups 39 are externally wrapped in a known manner with sheets of packaging material (not shown) supplied in a manner which is not shown by a spool 46 supported by a shaft 47 parallel to the shafts 41 and 44 and supported by the base 3.

In operation, the wheel 13 wraps the individual products 2 in a known manner (not shown), during their stepped transfer between the positions 15 and 17.

When a product 2 is introduced within a recess 28 of the head 23, the gripper which has conveyed it opens and the head 23 undertakes a rotary step.

Subsequent rotary steps of the head 23 bring each product 2 to the position 33, at which the removal means 34 remove the products 2 from the recesses 28, during the stops of the head 23, and insert them in the recesses 40 of the wheel 38 in accordance with the methods described above.

Figure 2:
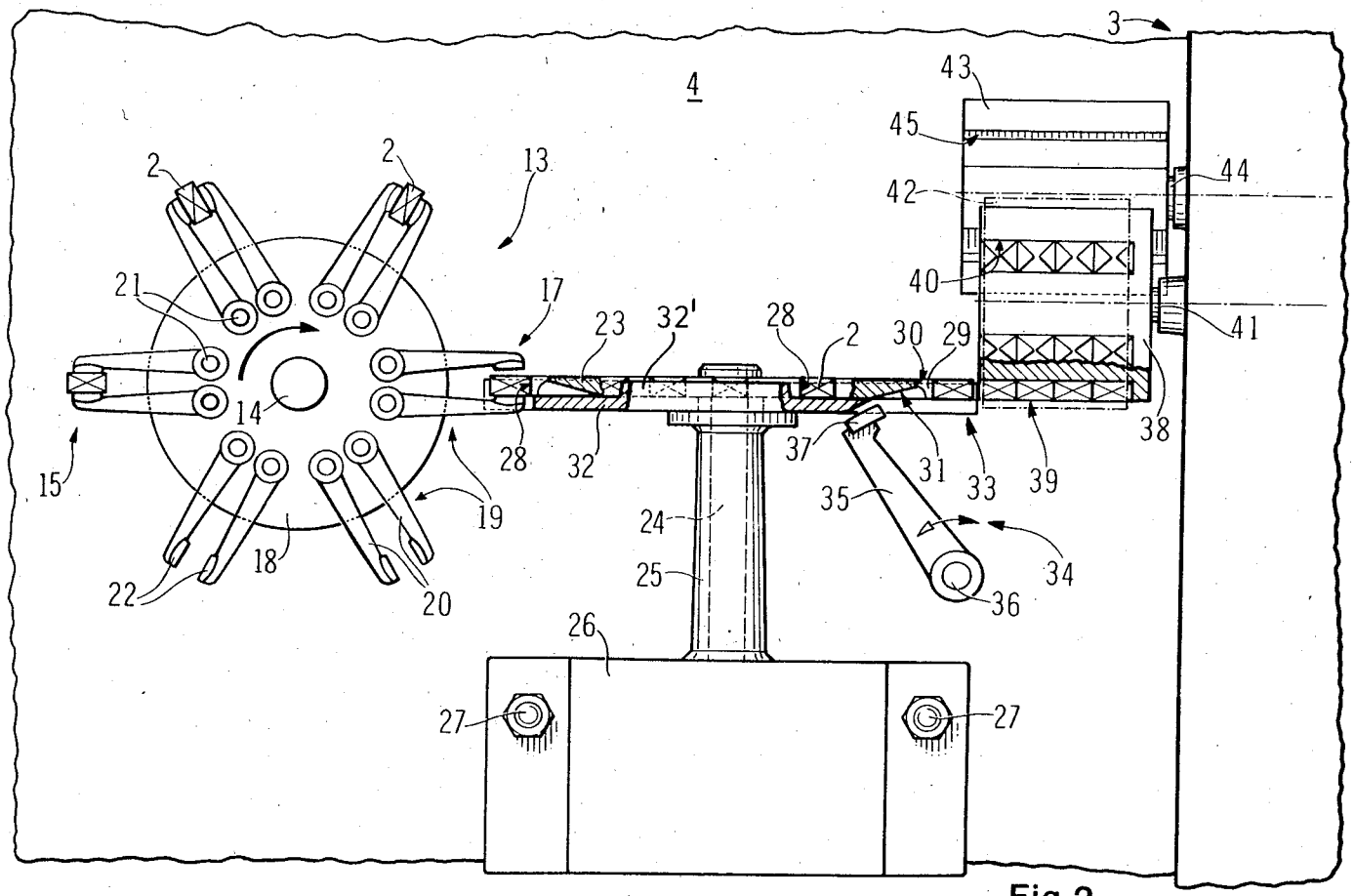
FIG. 2 shows, partly in section and in diagrammatic form, a front view of the machine of FIG. 1, in which the machine is designed to group products having a parallelepipedic flat shape, in order to obtain sticks, in an arrangement which intersects a plane perpendicular to the longitudinal dimension of the groups.

The groups 39 of products 2 which are successively formed and are composed, as shown in FIG. 2, of products 2 disposed such that they intersect a plane perpendicular to the longitudinal dimension of the groups 39, are then transferred into the recesses 45 of the wheel 43 so that they may be externally wrapped.

Figure 3:
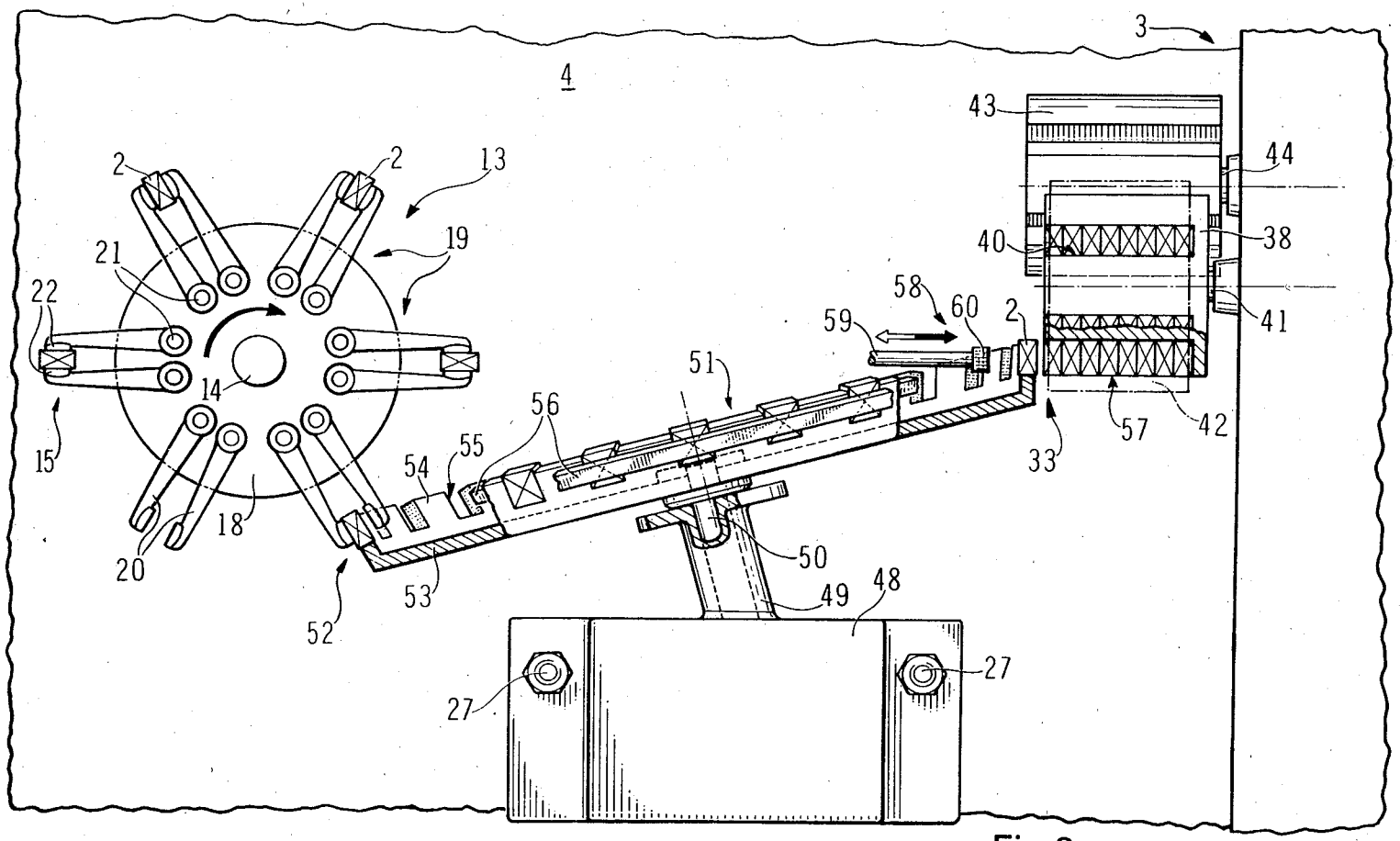
FIG. 3 shows, partly in section and in diagrammatic form, a front view of the machine of FIG. 1 in which the machine is designed to group products having a flat parallelepipe shape, inorder to obtain sticks, in which the products are arranged flat face-to-flat face transverse to the longitudinal direction of the groups.

The production of sticks in which the products 2 are disposed with their broad sides together may be carried out by modifying the machine 1 as shown in FIG. 3.

In this Figure, the box-shaped body 26, the tubular element 25, the shaft 24 and the head 23 with recesses supported thereon of FIG. 2 are replaced by a box-shaped body 48, a tubular element 49, a shaft 50 and a wheel or head 51 with recesses 55.

The axis of the tubular element 49, the shaft 50 and the head 51 is inclined towards the wheel 13 such that the head 51 extends with two opposite peripheral edges substantially between the mouth of the lower recess 40 of the wheel 38 and the gripper 19 which, when the wheel 13 is in the stop position, is disposed at a transfer position 52 disposed immediately downstream of the transfer position 17*a* of the head 23 with respect to the direction of rotation of the wheel 13 itself.

The disc 51 is constituted by a circular plate 53, with a superimposed peripheral ring 54 whose upper portion is provided with a plurality of the recesses 55 having a uniform angular spacing and each designed to receive a product 2 disposed with its two smallest faces lying in planes which are substantially parallel with respect to the head 51 and with their other smaller and larger faces substantially transverse and perpendicular to the plate 53.

A fairing 56, connected in a manner which is not shown to the tubular element 49 partially surrounds the periphery of the flange 54 between the position 52 and the wheel 38 so as to prevent the emergence of the products 2 from the recesses 55 during the rotation of the head 51.

The recesses 40 of the wheel 38 are dimensioned such that they may collect internally groups 57 of products 2 disposed with their flat broad sides together, and the actuator means for the grippers 19 must be adapted, with respect to the grippers used for the production of groups 39 of products 2 disposed such that they insersect the longitudinal dimension of the products 2, so as to cause in sequence the opening of each gripper 19 at the position 52 instead of the position 17.

Removal means 58 which replace the removal means 34 are disposed above the head 51 and comprise a horizontal spindle 59 parallel to the shaft 41. This spindle 59 is provided with an alternating axial movement by motor means (not shown), and supports, on its end facing the wheel 38, a thrust element 60 of resilient material, designed to be inserted in the recesses 55 during the stop periods of the head 51.

In operation, when a product 2 is inserted in a recess 55 of the head 51, the gripper 19 which has conveyed it opens and the head performs a rotary step.

Subsequent rotary steps of the head 51 convey each product 2 to the position 33 at which the removal means 58 successively removes the products 2 from the recesses 55, during the stop periods of the head 51, and places them with their flat broad sides together in the recesses 40 of the wheel 38. The groups 57 of products 2 gradually formed are then transferred into the recesses 45 of the wheel 43 for external wrapping.

It is obvious from the above Description that the machine 1 of the present invention may be modified, by replacing or adapting a relatively small number of components, for the production of both types of sticks described, without being subject to the drawbacks contained in the prior art.

There are many modifications which may be made to the wrapping machine described making use of the same principle and without departing from the scope of the invention.

Figure 4:
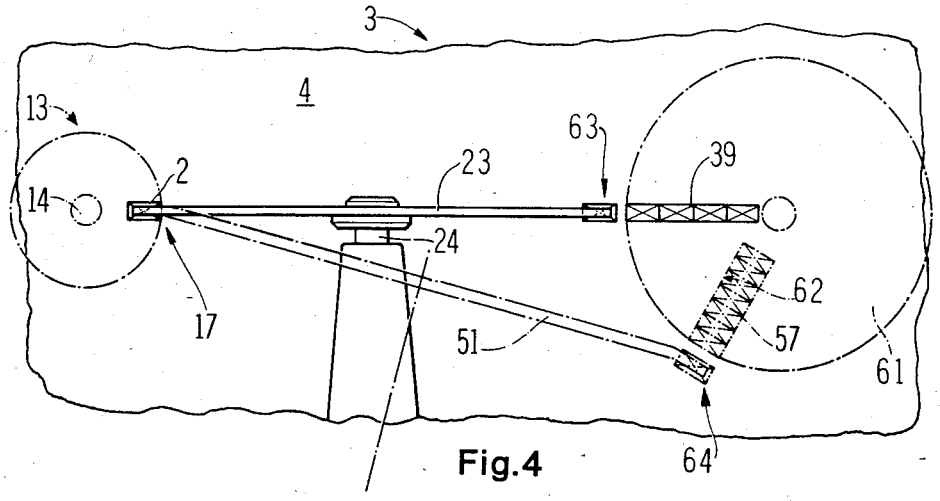
FIG. 4 shows, in diagrammatic form, a second embodiment of the invention.

For example, in FIG. 4, the axes of rotation of the heads 23 and 51 lie in a plane parallel to a plane which is perpendicular to the axis of the wheel for forming and conveying the groups 39 or 57 of products 2, rather than in a plane parallel to the plane in which the wheel lies.

This wheel, shown by 61 in FIG. 4, is provided with radially developing recesses 62.

In this case the head 23 (51) takes the products 2 from a specific position 17 of the wheel 13 and supplies them, in accordance with the inclination of its axis, at a position 63 or 64 of the wheel 61.

In the first case, groups 39 are formed within the recesses 62 of the wheel 61 in which the products 2 are disposed such that they intersect one another, while in the second case groups 57 are formed in which the products 2 are disposed while their flat broad sides together.

I claim:

1. A machine for wrapping and grouping products having a substantially parallelepipedic flat shape in packages in which the products can be oriented in at least two different positions, said machine comprising:

a first wheel steppingly rotatable on a horizontal axis and formed with a plurality of equally spaced gripper means extending radially outwardly from said wheel and adapted to releasably hold said products;

a second wheel spaced-apart from said first wheel and steppingly rotatable on a horizontal axis and formed around the periphery thereof with a plurality of equally spaced elongated axial recesses for receiving and grouping said products;

at least two conveyor heads selectively and interchangeably positioned between said first and second wheels and steppingly rotatable on a substantially upright axis, each of said conveyor heads being formed with a plurality of equally spaced recesses around the periphery thereof for directly receiving said products from said grippers, one of said conveyor heads being positioned so that the peripheral recesses thereof are brought into successive registration with said first wheel at a first transfer station, said peripheral recesses being intersected by the arcuate path of said gripper means at a point on said path whereby said products are deposited in the peripheral recesses of said one of said conveyor heads in a first oriented position, the other of said conveyor heads being positioned so that when the peripheral recesses thereof are brought into successive registration with said first wheel at a second transfer station offset from said first transfer station, the peripheral recesses of said other of said conveyor heads are intersected by said arcuate path at another point thereon whereby said products are deposited in said peripheral recesses in a second oriented position; and support means for selectively and interchangeably mounting and driving said two conveyor heads depending upon the product orientation chosen, whereby said differently positioned products are conveyed to a third transfer station adjacent said second wheel for deposition of the oriented products successively into said elongated axial recesses of said second wheel for directly forming said groupings to be wrapped.

2. The machine defined in claim 1 wherein said gripper means is formed by pairs of opposable arms pivotally mounted on said first wheel and carrying said products, and means operatively connected to said pairs of arms for at least opening same when in registration with a recess of either of said two conveyor heads for depositing a product therein.

3. The machine defined in claim 1 wherein the horizontal axes of the first and second wheels are mutually perpendicular and lie in different planes.

* * * * *